United States Patent [19]

Klee et al.

[11] 4,145,870

[45] Mar. 27, 1979

[54] PROCESS FOR THE PRODUCTION OF TEXTURED FILAMENT YARNS WITH THE APPEARANCE OF STAPLE FIBRE YARNS

[75] Inventors: Rudolf J. Klee, Dormagen; Gerd Arenz, Leverkusen; Herbert Scherzberg, Dormagen, all of Fed. Rep. of Germany

[73] Assignee: Bayer Aktiengesellschaft, Leverkusen, Fed. Rep. of Germany

[21] Appl. No.: 843,844

[22] Filed: Oct. 20, 1977

[30] Foreign Application Priority Data

Oct. 29, 1976 [DE] Fed. Rep. of Germany ..... 2649266

[51] Int. Cl.[2] ..... D02G 1/02; D02G 1/20

[52] U.S. Cl. ..... 57/288; 28/258; 28/271; 57/245; 57/289; 57/247; 57/908

[58] Field of Search ..... 57/140 R, 140 BY, 157 TS, 57/157 R, 34 HS, 157 F; 28/258, 271–276

[56] References Cited

U.S. PATENT DOCUMENTS

| | | | |
|---|---|---|---|
| 3,583,147 | 6/1971 | Brizzolara, Jr. et al. | 28/274 X |
| 4,010,523 | 3/1977 | Hense et al. | 28/274 X |
| 4,043,010 | 8/1977 | Gorrafa | 57/157 TS X |
| 4,054,025 | 10/1977 | Kubitzek et al. | 57/157 TS |

*Primary Examiner*—John Petrakes
*Attorney, Agent, or Firm*—Plumley and Tyner

[57] ABSTRACT

The invention is related to a process for the production of staple-fibre-like textured continuous filament yarns by interlacing and false-twisting, wherein a partly drawn filament is heat-treated before the texturing process, this filament is subsequently interlaced with a non shrunken filament and both are finally subjected to draw texturing.

9 Claims, No Drawings

PROCESS FOR THE PRODUCTION OF TEXTURED FILAMENT YARNS WITH THE APPEARANCE OF STAPLE FIBRE YARNS

This invention relates to a process for the production of staple fibre-like textured continous filament yarns by interlacing and false twisting.

It is known that high-bulk yarns can be produced by mixing individual fibres having different shrinkage levels. The bulk of the yarn increases when the high-shrinkage constituents are allowed to fully shrink thus forcing the non-shrinking constituents out of the fibre assemblage. This method of producing high bulk yarns is applied in particular to staple fibres, although it has also been applied continuous filament yarns.

In the latter case, the bulk yarn is obtained by interlacing two filaments which differ from one another in their shrinkage and of which one is overfed followed by texturing. During the texturing process, the filament with the higher shrinkage contracts, pushes out the filament with the lower shrinkage and produces the bulk effect. This effect is intensified by the overfeed of the lower-shrinkage filament. At the same time, the non-shrunk filament tends to develop capillary breaks so that the staple-fibre-yarn-like effect is obtained. If therefore the difference in shrinkage amounts to 10% and if the overfeed of one filament over the other filament also amounts to 10%, a difference in length of 20% is obtained.

It is also known that the physical structure of a filament entering the texturing zone can be influenced by preheating and that special effects, for example a lower crimp, can be obtained in this way.

However, the staple fibre yarn effect hiterto obtained in this way is still in need of improvement because the effect is not adequately reflected in the finished article. Accordingly, the object of the present invention is to improve the processes described above.

Such an improvement is obtained when the differential shrinkage is produced by fully shrinking one of the filament components of thermoplastic endless filaments of synthetic material, especially polyester, which have not been fully drawn by means of a preceding heating element. At the same time, the structure may be modified in different ways, depending on how the filaments pass through the heating zone formed by the heating element, i.e. depending on whether the filaments pass through the heating zone with or without a possibility of shrinkage. The heat treatment with or without shrinkage embrittles one of the filament components. In the subsequent texturing process, this leads to capillary breaks whereby the staple-fibre-like charcter is produced.

Accordingly, the present invention provides a process for the production of staple-fibre-like textured continuous filament yarns by interlacing and false-twisting, wherein a partly drawn filament is heat-treated before the texturing process, this filament is subsequently interlaced with a non-shrunken filament and both are finally subjected to draw-texturing.

Preferred feed yarns for the process according to the invention are polyester filament yarns, especially those of polyethylene terephthalate and polybutylene terephthalate. The partial drawing is preferably obtained by high-speed spinning, more especially by spinning at rates of from 3,000 to 3,500 m per minute, so that the residual drawing ratio of the filaments amounts to between 1:1.5 and 1:1.7.

The heat treatment is carried out at 130° C. to 180° C. either on the bobbin or continuously on the travelling filament by means of a heating element of the kind commonly used for drawing processes. The heat treatment is carried out either with permitted shrinkage of from 10% to 50% or under tension.

The texturing stage comprises a conventional false-twist process in which the false twist is imparted by means of a spindle twister or a friction spindle twister and in which the false twist zone is simultaneously used as drawing zone. False-twist texturing processes of this type are described, for example, in "Stand und Zukunft der Texturierung", Deutscher Fachverlag GmbH, Frankfurt-on-Main, published by Burkhard Wulfhorst, 1975. The interlacing process carried out before or after the texturing process is also prior art and is not in itself the subject of the present invention. In this connection, reference is made in particular to U.S. Pat. No. 2,985,995 in which interlacing processes are described in detail.

The temperature in the false twist zone of the texturing zone is in the range of from 190° C. to 230° C. The drawing ratio adjusted in this zone is preferably in the range from 1:1.5 to 1:1.7.

Particularly the process is carred out for example by using two filaments of a preoriented polyester with a denier of 167 dtex. One filament preferably enters the delivery rollers of the texturing machine with shrinkage during the preheating step. The other filament of the same origin and having the same shrinkage in boiling water enters the same delivery rollers without any thermal pretreatment. The two filaments are then draw-textured together by a pin or a friction twister in accordance with the residual drawing ratio of the starting material and modified by producing capillary breaks.

EXAMPLE 1

Filaments of polyethylene terephthalate with a denier of 255 dtex were used for the process according to the invention. The filaments had a shrinkage in boiling water of 50% and a residual elongation of 65%.

One of the filaments was passed through the heating zone at a temperature of 180° C. and with a shrinkage possibility of 50%. In this way, the filament was fully shrunk and had an elongation at break of from 80 to 100% and a tensile strength of from 500 to 600 ponds.

At the same time, however, its stress-strain behaviour was also altered. This fully shrunk filament was then textured together with a non-shrunken filament in the texturing zone with a friction twister at a temperature of 210° C. (drawing ratio 1:1.45). In addition to the conventional texturing character, the yarn obtained showed protruding filament ends which resembled staple fibre yarns.

EXAMPLE 2

Two polyethylene terephthalate filaments with a denier of 58 dtex produced by a high-speed spinning process were used. One of the filaments was shrunk at 170° C. and introduced together with the other filament into a texturing unit. Drawing and texturing were carried out at 190° C. according to the residual drawing ratio of the filament of 1:1.3, the twist applied amounting to 2600 turns per meter.

In addition to the conventional texturing character, the yarn obtained showed protruding filament ends which were like staple fibre yarns. By a known interlacing process carried out before or after the texturing process, the yarns were prevented from shifting relative to one another in both cases, i.e. both in Example 1 and also in Example 2.

We claim:

1. A process for the preparation of staple-fiber-yarn-like textured filament yarns which comprises subjecting a partially drawn filament yarn to heat at a temperature of about 130° to 180° C. and thereafter interlacing said filament yarn with a filament yarn which has not been thermally treated and thereafter subjecting the resultant interlaced yarn to draw-texturing by the false-twist method.

2. A process as claimed in claim 1, wherein the heat treated filament yarn is interlaced with the non-thermally treated filament yarn prior to draw-texturing.

3. A process as claimed in claim 1, wherein the heat treated filament yarn and non-thermally treated filament-yarn are together subjected to draw texturing and subsequently interlaced.

4. A process as claimed in claim 1, wherein the partially drawn filament yarn is a polyester filament yarn obtained by spinning at a rate of from 3000 to 3500 m per minute and having a residual drawing ratio of from 1:1.5 to 1:1.7.

5. A process as claimed in claim 1, wherein the partially drawn filament yarn is heat treated in packaged form or, travelling continuously on a heating element.

6. A process as claimed in claim 1, wherein the partially drawn filament yarn undergoes from 10 to 50% shrinkage during the heat treatment.

7. A process as claimed in claim 1, wherein the partially drawn filament yarn is heat treated under tension.

8. A process as claimed in claim 1, wherein the filament yarns are together drawn in a ratio of 1:1.5 to 1:1.7 in a false-twist zone.

9. A process as claimed in claim 1, wherein the filament yarns are draw texturized under heat.

* * * * *